United States Patent [19]

Elias et al.

[11] Patent Number: 4,576,314

[45] Date of Patent: Mar. 18, 1986

[54] DEVICE FOR SQUEEZING AND WINDING COLLAPSIBLE TUBES

[76] Inventors: Abe G. Elias, 3300 Skyline Blvd., Apartment 208, Reno, Nev. 89509; Peter G. Elias, 6 Wedgewood Dr., Winnipeg, Manitoba, Canada, R3T 2J8

[21] Appl. No.: 552,349

[22] Filed: Nov. 16, 1983

[51] Int. Cl.[4] ..... B65D 35/28

[52] U.S. Cl. ..... 222/97; 222/99; 222/103

[58] Field of Search ..... 222/97, 99, 100, 103; D6/541

[56] References Cited

U.S. PATENT DOCUMENTS

| | | | |
|---|---|---|---|
| Re. 27,689 | 6/1973 | Hausmann et al. . | |
| 1,692,213 | 11/1928 | Kielberg | 222/99 |
| 1,826,189 | 9/1931 | Rothwell . | |
| 1,973,543 | 9/1934 | Simon . | |
| 1,990,929 | 2/1935 | Bonham | 222/99 |
| 2,896,822 | 7/1959 | Songer . | |
| 3,248,012 | 4/1966 | Adams . | |
| 3,473,698 | 10/1969 | Ballin . | |
| 3,536,234 | 10/1970 | Rise | 222/103 |
| 3,759,421 | 9/1973 | Hausmann . | |
| 3,885,708 | 5/1985 | Parry . | |
| 3,910,460 | 10/1975 | Hausmann et al. . | |
| 3,920,157 | 11/1975 | Young . | |
| 4,159,787 | 8/1979 | Wright . | |
| 4,301,945 | 11/1981 | Dworkin . | |

FOREIGN PATENT DOCUMENTS

| | | | |
|---|---|---|---|
| 334185 | 12/1958 | Switzerland | 222/99 |
| 315660 | 7/1929 | United Kingdom | 222/97 |

*Primary Examiner*—H. Grant Skaggs

*Attorney, Agent, or Firm*—Bernard, Rothwell & Brown

[57] ABSTRACT

A device for squeezing successive portions of a collapsible tube containing a dischargeable material, such as toothpaste, and for winding the emptied tube portion includes a longitudinally split tubular body portion which flexibly and resiliently supports a pair of jaws on opposite sides of the longitudinal slit for extending over opposite sides of a collapsible tube portion from which the contents are to be squeezed. The jaws are squeezed together manually by the user and the emptied portion of the collapsible tube is wound on a key extending into a cylindrical cavity within the tubular portion.

18 Claims, 34 Drawing Figures

DEVICE FOR SQUEEZING AND WINDING COLLAPSIBLE TUBES

TECHNICAL FIELD

The present invention relates to devices for expressing contents, such as toothpaste, from collapsible tubes and winding the emptied portion of the tube to prevent reentry of the tube contents into the emptied portion.

DESCRIPTION OF THE PRIOR ART

The prior art contains many devices for expressing toothpaste from collapsible tubes and winding up the emptied tube portions on keys, as exemplified in U.S. Pat. Nos. RE27689; 1,973,543; 3,910,460; 3,759,421; and 3,885,706. Generally, the prior art employs a relatively rigid structure having an elongated opening through which the toothpaste tube is pulled by winding on a key shaft extending within a cavity in the device. The opening is narrow and usually has a rounded or beveled configuration for expressing the contents from portions of the tubes being pulled through the opening. The frictional resistance to the tubes being pulled through the opening requires relatively large winding forces tending to rupture the tube and creating difficulties in operating the device. The U.S. Pat. No. 3,885,708 describes a spring-like structure by which the operator may manually separate the jaw portions on opposite sides of the elongated openings to permit initial installation of the tube and key into the slot and winding cavity. Additionally the U.S. Pat. No. 3,885,708 discloses hinged flaps which may be pivoted against portions extending from the slot to advance portions of the contents ahead of the jaws to reduce sharp bends in the tube tending to reduce rupture of the tube as it is pulled through the opening.

SUMMARY OF THE INVENTION

The present invention is summarized in a device for squeezing and winding a collapsible tube including a body having a pair of jaw portions which are integrally formed with a tubular portion wherein the tubular portion has an axially extending opening and the jaw portions extend outward from the tubular portion on respective opposite sides of the opening, the tubular portion defining a cavity for receiving an empty collapsible tube, a slotted elongated key for extending axially in the cavity and having a handle portion for winding and pulling an empty portion of the collapsible tube through the opening into the cavity, the tubular portion also defining a flexible wall portion which permits the jaw portions to separate and admit a content containing portion of the collapsible tube therebetween, and the jaw portions being adapted for being readily engaged and squeezed by the fingers of the user to squeeze the content containing tube portion between the jaws to express the contents from the content containing tube portion.

An object of the invention is to construct a device which is relatively inexpensive and easy to use for aiding in the discharging and winding of a collapsible tube from which contents are dispensed.

Another object of the invention is to substantially reduce the tendency for winding and expressing devices for collapsible tubes to rupture the tubes causing spillage of contents.

One advantage of the invention is that the contents of a portion of a collapsible tube between flexibly supported jaws are expressed by the user squeezing the jaws together prior to winding to greatly reduce required winding forces.

One feature of the invention is that jaw portions are flexibly supported so that they readily separate when a content containing portion of the collapsible tube is advanced between the jaws to produce relatively insubstantial retarding forces for winding the collapsible tube.

Other objects, advantages and features of the invention will be apparent from the following description of the preferred embodiment taken in conjunction with the accompanying drawings.

DESCRIPTION OF THE PREFERRED EMBODIMENT

Figure 1:
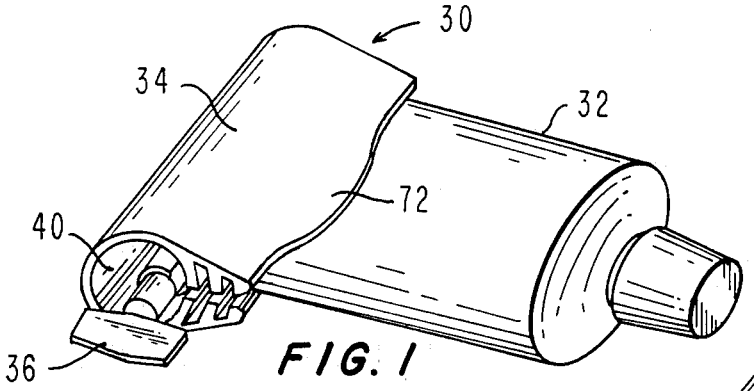
FIG. 1 is a perspective view of a collapsible tube and a device for squeezing and winding the collapsible tube in accordance with the invention.
Figure 2:
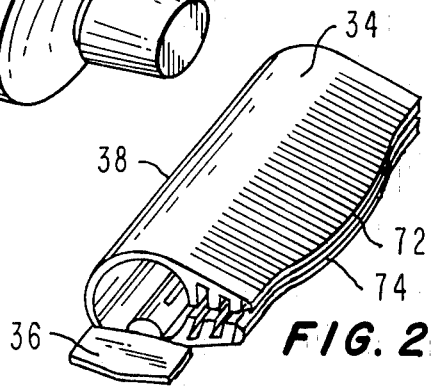
FIG. 2 is a perspective view of the device without the tube at FIG. 1.
Figure 4:
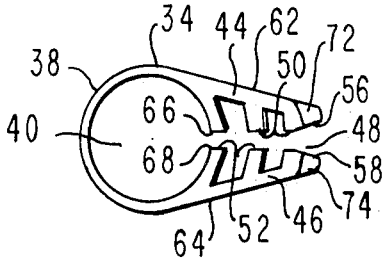
FIG. 4 is a side view of a body member of the device of FIG. 2.
Figure 5:
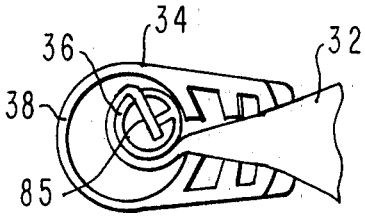
FIG. 5 is a cross-sectional view of the device illustrating one step of its use.

As illustrated in FIG. 1, the invention is embodied in a device indicated generally at 30 for squeezing and winding a collapsible tube 32 which contains a material, for example, toothpaste which is discharged through an open end of the tube when the cap is removed therefrom. The device 30 includes a body 34 and a key 36. The body 34 as illustrated in FIGS. 1, 2, 4, 5 and 7 is generally elongated transversely to the tube 32 and includes a tubular portion 38 which defines a wall circumscribing a cavity 40 extending the length of the body 34 and being open at both ends for receiving the key 36 upon which the emptied portion of the collapsible tube is wound. Jaws 44 and 46 integral with the tubular portion 38 extend outwardly from the tubular portion 38 and define an opening or slit 48 into the chamber 40 extending longitudinally through the entire length of the body 34. The wall of the tubular portion 38 is selected to have sufficient flexibility to permit the jaws 44 and 46 to readily separate or flex, as shown in FIG. 5, when a portion of the tube 32 containing toothpaste is pulled between the jaws. The jaws 44 and 46 are adapted to be engaged by the fingers of a user to squeeze the jaws together and to express the contents of the portion of the tube between the jaws 44 and 46.

The body 34 is formed by molding a plastic material which is selected to be highly impact resistent, non-brittle and withstand repeated flexing of the jaws 44 and 46. Examples of suitable plastic materials include high-impact polystyrene, ABS, or polypropylene. The tubular portion 38 is generally circular in cross-sction with the wall spaced from the opening 48 and having a thickness selected in conjunction with the plastic material to have a flexibility and resilience to avoid large frictional forces as the partially filled portion of the tube is pulled between the jaws 44 and 46 causing the jaws to separate. The structure of the jaws 44 and 46 is designed to be substantially more rigid than the tubular wall structure 38 and have respective inner surfaces 50 and 52 which extend in respective planes defining the slot 48 and extending generally radially from an axis of the tubular portion 38. Bevelled inner surfaces 56 and 58 are formed at the distal ends of the jaws 48 and 46 for aiding in readily camming the jaws 44 and 46 apart as a content containing portion of the tube 32 as advanced between the jaws. Flat planar outer surfaces 62 and 64 of the jaws 44 and 46 extend tangentially from the outer surfaces of the tubular portion 38 and define, with the respective inner surfaces 50 and 52, a generally tapered jaw configuration. The lengths of the jaw squeezing surfaces 50 and 52, i.e. the distance from the cavity 40 to the distal end of the jaws as viewed in FIG. 4, is selected to permit a substantial section of the collapsible tube 32 to be squeezed but to not have an excessive area of squeezing which would require too great a squeezing force by the user. Generally for devices for toothpaste tubes, a squeezing surface length within the range from 3/16 to $1\frac{5}{8}$ inches (5 mm to 40 mm) is suitable with a length from $\frac{3}{8}''$ to $\frac{5}{8}''$ (9 to 16 mm) being preferred. The inner corners 66 and 68 of the jaw surfaces 50 and 52 are generally sharp corners for aiding in expressing portions of contents which may remain in the collapsible tube after squeezing. Curved protrusions or extensions 72 and 74 are formed centrally on the distal ends of the respective jaws 40 and 46 and extend coplanarly therefrom. The extensions 72 and 74 are designed to increase the engagement surface for the user's fingers as well as to provide extensions of the beveled surfaces 56 and 58 at the maximum diameter of the collapsible tube 32. Extensions 72 and 74 also help in the removal of the last contents of the tube 34 by digging into the head part of the tube. Various ribs and openings illustrated as longitudinal slits in the interior of the jaws 44 and 46 are designed for improving the plastic molding process by decreasing the material requirements and by decreasing the mold heating and cooling times.

Figure 3:
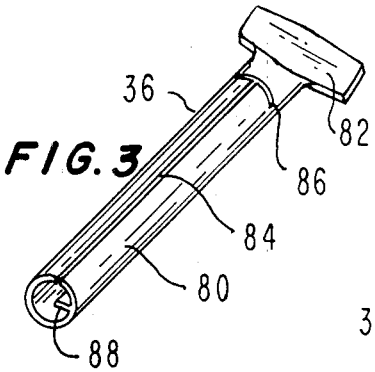
FIG. 3 is a perspective view, taken from an opposite direction, of a winding key in the device of FIG. 2.

The key 36, as illustrated in FIG. 3, has an elongated tubular shaft 80 with a flattened handle portion 82 on one end of the shaft 80. A longitudinal slot 84 is formed from the open end of the shaft 80 to a transverse slot 86. A rib or beam 88 extends from the interior wall at about 90 degrees relative to the slot 84 into the center of the tubular shaft 80 for engaging the end of the collapsible tube 32 to ensure a sharp bend as the tube passes out of the slot 84 as illustrated in FIG. 5, to result in the end being held more firmly and positively to aid in winding the tube more efficiently.

Figure 6:
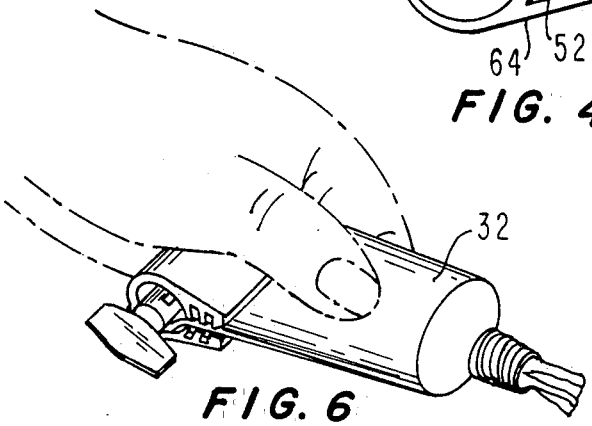
FIG. 6 is a perspective view of the device in tube of FIG. 1 illustrating use by an operator.
Figure 7:
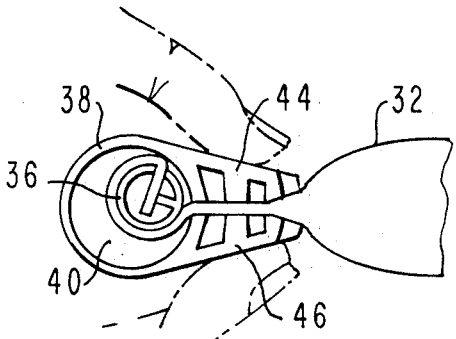
FIG. 7 is a view similar to FIG. 5 but illustrating another step in the use of the device.
Figure 8:
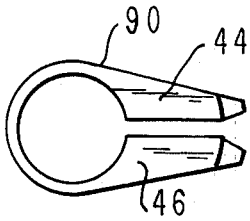
FIG. 8 is a side view of a variation of the body of FIG. 4.
Figure 9:
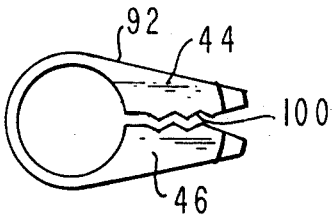
FIG. 9 is a side view of a second variation of the body of FIG. 4.
Figure 10:
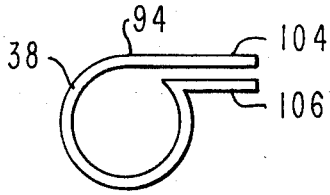
FIG. 10 is a side view of a third variation of the body of FIG. 4.
Figure 11:
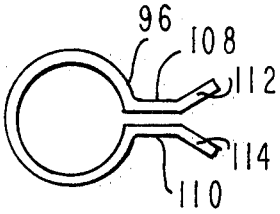
FIG. 11 is a side view of a fourth variation of the body of FIG. 4.

In use, the sealed end 85 of the collapsible tube 32, such as a toothpaste tube, is inserted into slot 84 of the shaft 80 of the key 36. The key and the portion of the tube 32 adjacent to the key are inserted into the device 30; the jaws 44 and 46 of the device 30 being urged apart by the insertion of the portion of the tube 32 adjacent to the end sideways into the slot 48. Toothpaste or, other contents may then be selectively discharged from the tube, for example, as illustrated in FIG. 6.

When the tube 32 starts to have a disorderly appearance, the jaws 44 and 46 are squeezed together to express the contents of the portion of the tube between the jaws. The key is rotated winding the emptied portion of the tube onto the shaft 80 of the key. During the winding the tube 32 passing into the cavity 40 engages one of the sharp edges 66 and 68 ensuring that substantially all of the contents in the tubular portion being wound has been removed. The squeezing of the jaws and the winding may be repeated until the remaining portion of the collapsible tube 32 extending from the device 30 has a normal filled appearance.

Alternatively, the squeezing of the jaws 44 and 46 may be used directly to dispense the contents of the collapsible tube 32 from the open end. The squeezing can be easily controlled or stopped when the desired quantity has been dispensed in a manner similar to the direct squeezing of the tube 32 by the fingers.

A device in accordance with the invention has a substantially improved and easier operation than prior art devices which require the pulling of the tube between closely spaced rigid jaws to force the contents toward the openable end of the collapsible tube. The forcing of the contents is performed by a squeezing action which does not tend to tear or rupture the collapsible tube. Winding of the key is substantially easier because the winding force does not include the frictional engagement forces with the exterior of the tube as required in the prior art tube force the contents toward the openable end.

In FIGS. 8–11, there are illustrated variations 90, 92, 94 and 96 of the body of the device in accordance with the invention. In the variation 90, the jaws 44 and 46 are solid. In the variation 92, the interior surfaces of the jaws 44 and 46 are formed with respective mating teeth or serations 100 for fully ensuring that the material is expressed from the portion of the tube between the jaws. The variation 94 shows jaws 104 and 106 which are relatively thin and have a similar thickness to the wall of the tubular portion 38. The jaw 104 extends tangentially to the circular wall 38 while the jaw 106 extends at an acute angle to the wall 36. In the variation 96 jaws 108 and 109 of thickness similar to the jaws 104 and 106 extend generally perpendicularly and radially relative to the center of the tubular portion 38. The jaws 108 and 110 have flared distal ends 112 and 114 for guiding and camming the jaws apart when the tube is advanced therein.

Figure 12:
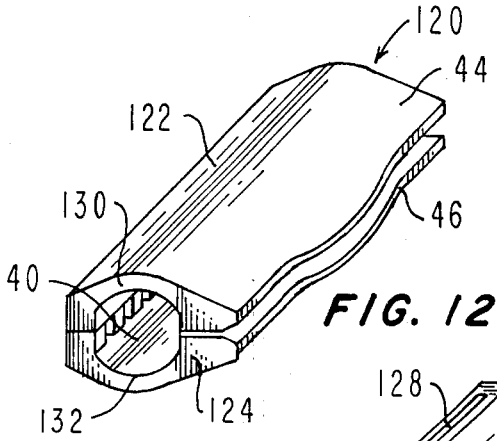
FIG. 12 is a perspective view of a modified body for employment in a device in accordance with the invention.
Figure 13:
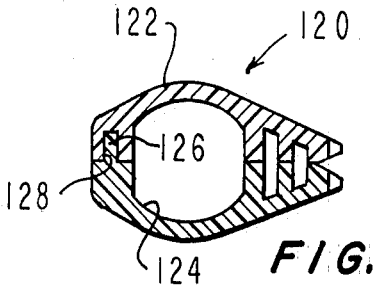
FIG. 13 is a cross-section view of the body of FIG. 12.
Figure 14:
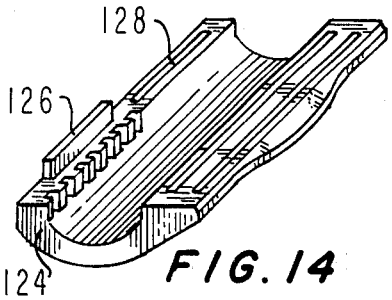
FIG. 14 is a perspective view of one member of the body of FIG. 12.

In FIGS. 12, 13 and 14 there is illustrated a modification indicated generally at 120 of the body of the device in accordance with the invention. The modification 120 has upper and lower halves 122 and 124 which are secured together at one side by mating tongues 126 and grooves 128. Portions 130 and 132 of the respective upper and lower members 122 and 124 provide the flexible support for the jaws 44 and 46.

Figure 15:
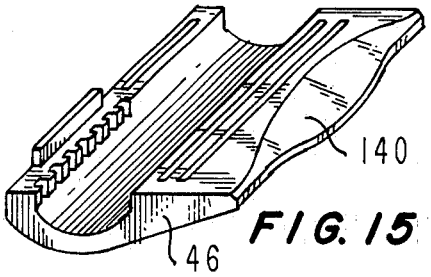
FIG. 15 is a perspective view of a variation of the body member of FIG. 14.

In a variation of the molded split halves, illustrated in FIG. 15, a concave surface 140 is formed centrally in the distal portion of the inner surface of the jaws (only jaw 46 being illustrated in FIG. 15). This concavity is selected to guide the collapsible tube centrally between the jaws 44 and 46.

Figure 16:
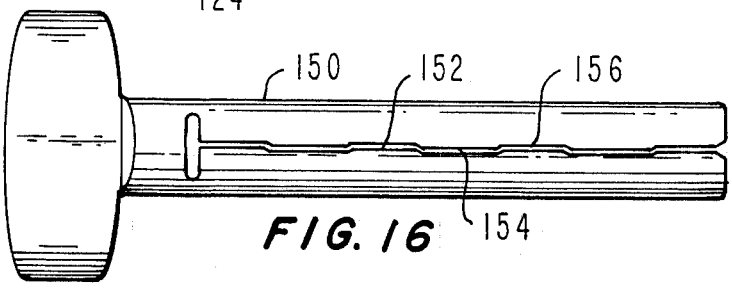
FIG. 16 is a plan view of a modified key for use in the device in accordance with the invention.

A modified key 150, shown in FIG. 16, has a slot 152 which is sinuous and extends along the longitudinal dimension of the tubular shaft portion of the key. The sinuous shape of the slot 152 forms alternating portions 154 and 156 which are offset with respect to one another. The sinuous shape of the slot 152 provides more positive gripping of the sealed end of the collapsible tube.

Figure 17:
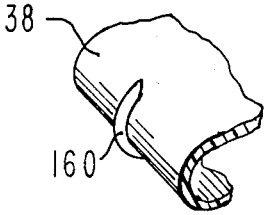
FIG. 17 is a perspective view of one modification which may be included in the body portion of a device in accordance with the invention.
Figure 18:
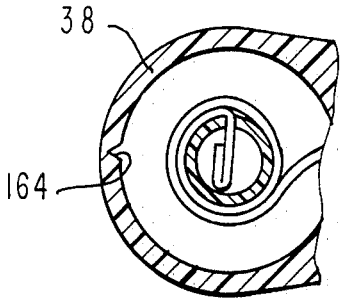
FIG. 18 is a cross-section view illustrating a second modification which may be included in a device in accordance with the invention.

In FIGS. 17 and 18, modifications to the wall of the tubular portion 38 are illustrated for varying the flexibility of a portion of the wall. In FIG. 17 an exterior rib or ridge 160 is formed on the wall 38 for stiffening a portion of the wall. In FIG. 18 a longitudinal groove or slot 164 is formed in the interior of the wall for providing increased flexibility at the groove 164.

Figure 19:
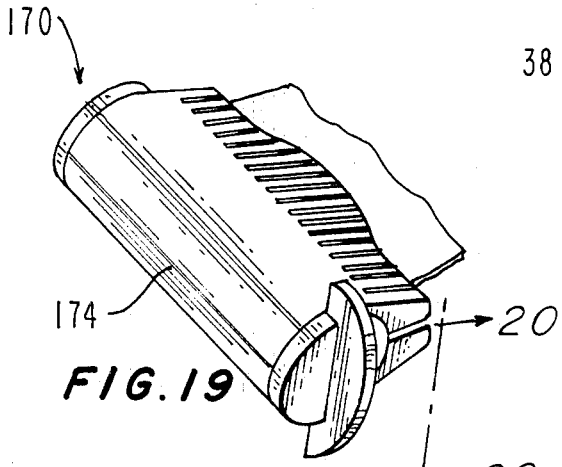
FIG. 19 is a perspective view of still another modified device in accordance with the invention.
Figure 20:
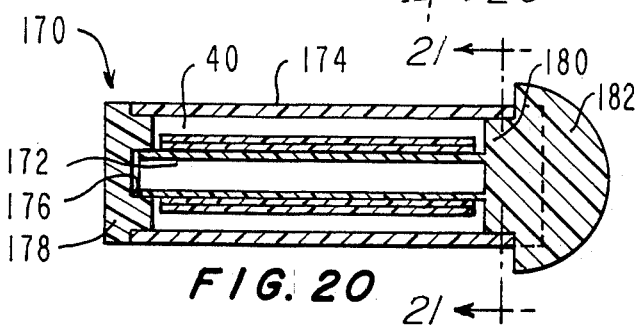
FIG. 20 is a section view taken at line 20—20 in FIG. 19.
Figure 21:
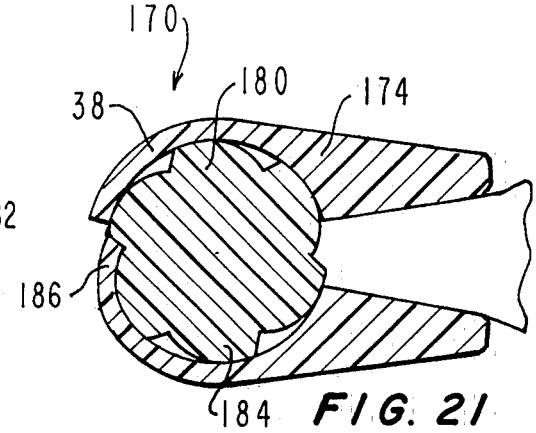
FIG. 21 is a section view taken at line 21—21 in FIG. 20.

A further modified device, indicated generally at 170 in FIGS. 19, 20 and 21, has a key 172 which is fixed in position within the elongated body 174 rather than being loose as in the above described embodiments. A distal end of the shaft portion of the key 172 is rotatably supported within a bore 176 of an end cap 178 secured in one end of the cavity 40 of the body 174. A rachet portion 180 is formed on the key 172 adjacent to the handle 182 for engaging in the opposite end of the cavity 40. The rachet portion 180 includes rachet teeth 184 which cooperate with a pall portion 186 cut from the wall of the tubular portion 38 of the body 174. This rachet and pall arrangement prevents the key 172 from unwinding and is especially useful with certain plastic tubes which tend to unwind.

Figure 22:
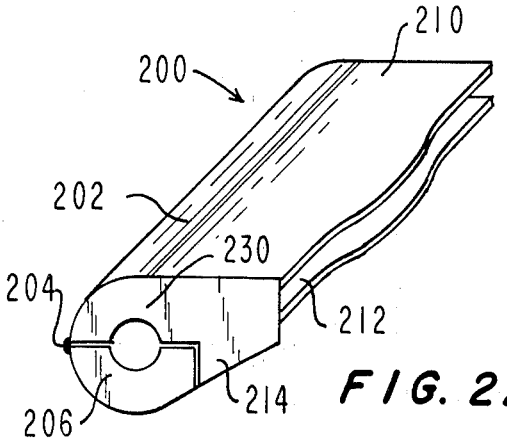
FIG. 22 is a perspective view of another modified body for employment in a device in accordance with the invention.
Figure 23:
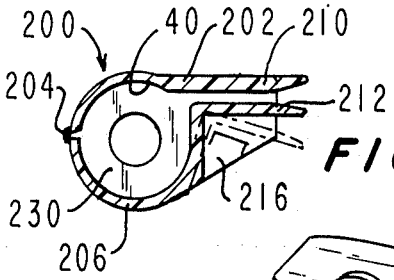
FIG. 23 is a cross section view of the body of FIG. 22.
Figure 25:
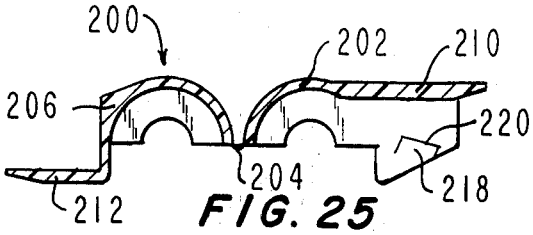
FIG. 25 is a cross-section view similar to FIG. 23 but illustrating the body with its two halves in an open condition.

A modified body, indicated generally at 200 in FIGS. 22, 23 and 25, has an upper member 202 which is hinged by a hinge 204 to a lower member 206. The hinge 204 is formed by a thin layer of flexible plastic joining the upper and lower halves 202 and 206 throughout the length thereof (from the front to the back as shown in FIG. 22) and is conveniently formed during molding of the upper and lower halves 202 and 206. This hinge 204 provides the flexible support permitting the upper and lower halves 202 and 206 to separate and admit a content containing portion of the collapsible tube between jaws 210 and 212 of the respective members 202 and 206. The jaw 210 extends tangentially to the circular wall of the upper member 202 while the jaw 212 extends at an acute angle to the wall of the member 206, which walls form the cavity 40 therein for receiving the spent tube portion.

Figure 27:
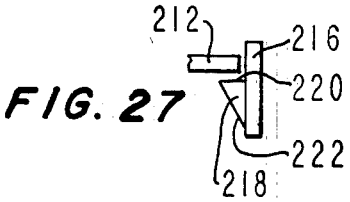
FIG. 27 is a broken away view of a portion of the body of FIGS. 22 and 23.

Wing portions 214 and 216 extend downward from opposite ends of the upper jaw 210 for receiving the lower jaw 212 therebetween. Wedge-like stop members 218, see FIG. 27, are mounted on the inner surfaces of the lower portions of the wings 214 and 216 for limiting normal downward movement of the jaw 212 relative to the jaw 210. The upper stop surface 220 of the wedges 218 is spaced sufficiently below the jaw 210 to permit the jaw 212 to normally move within a range permitting entry of a content containing tube portion between the jaws 210 and 212. The lower surface or portion 222 of the stops 218 are wedge-shaped or inclined to force the wings 214 and 216 apart when the members 202 and 206 are snapped shut from the open condition as shown in FIG. 25. The wings 214 and 216 may be spread sufficiently apart by extra downward force on the jaw 212 or by outward force on wings 214 and 216 to permit the jaw 212 to disengage from between the wings 214 and 216.

Figure 24:
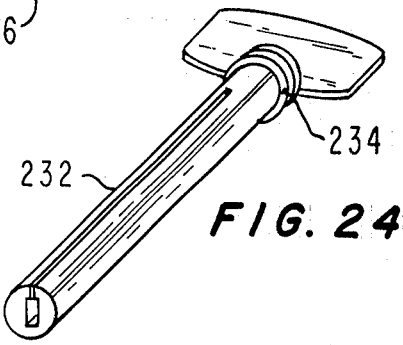
FIG. 24 is a perspective view of a modified key for use in a device utilizing the body of FIG. 22.
Figure 26:
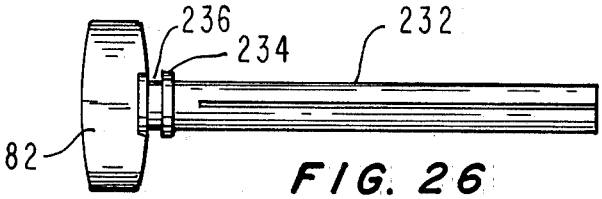
FIG. 26 is a plan view of the key of FIG. 24.

Semi-annular end wall portions 230 are formed at the opposite ends of the members 202 and 206 defining end walls partially enclosing the ends of the cavity 40 and defining central openings for receiving the tubular portion 232 of a modified key shown in FIGS. 24 and 26. An annular ring or ridge 234 is formed on the tubular portion 232 adjacent to the handle 82 for defining a groove 236 receiving the end wall members 230 so that the key is retained in the body 200 when the upper and lower portions 202 and 206 are closed.

Figure 28:
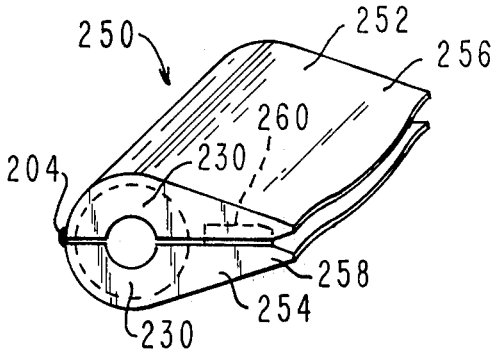
FIG. 28 is a perspective view of a variation of the body of FIG. 22.
Figure 29:
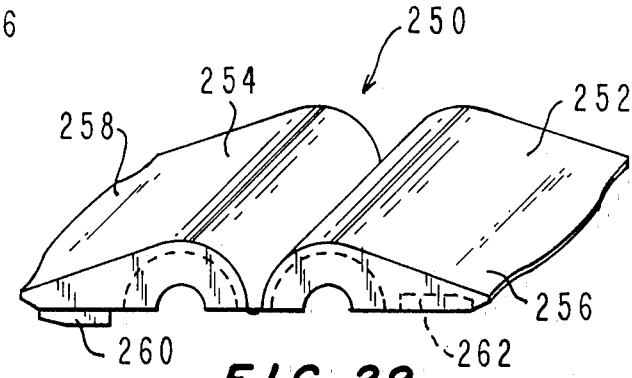
FIG. 29 is a perspective view similar to FIG. 28 but illustrating the body in an open condition.
Figure 30:
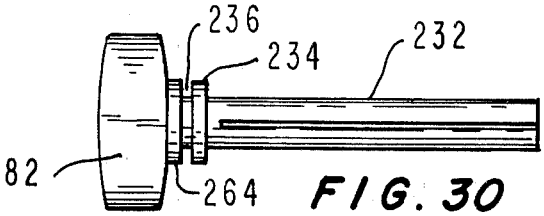
FIG. 30 is a plan view of a key for use with the variation of FIG. 28.
Figure 31:
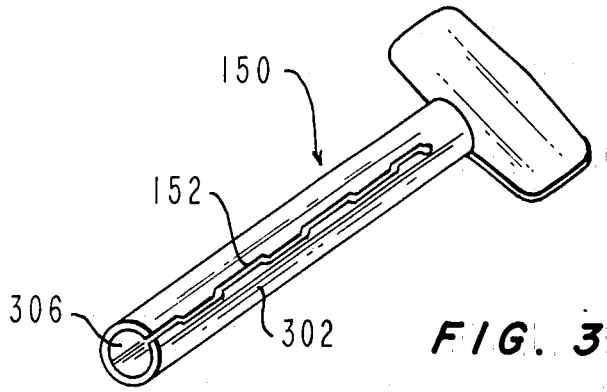
FIG. 31 is a perspective view of a variation of the key of FIG. 16.
Figure 32:
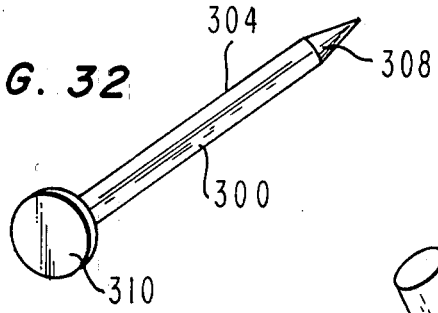
FIG. 32 is a perspective view of a pin for use with the key variation of FIG. 31.

In a variation, indicated generally at 250 in FIGS. 28 and 29, upper and lower body members 252 and 254 are hingedly joined by the hinge 204 similar to that of the variation in FIGS. 22, 23 and 24. Jaws 256 and 258 of the respective upper and lower portions are similar to jaws 44 and 46 of the embodiments of FIGS. 1, 2 and 4. Prongs 260 are formed adjacent the opposite ends of the lower jaw 258 to extend upwardly therefrom for being received within corresponding recesses or slots 262 formed in the ends of the upper jaws 256. The prongs 260 and recesses 262 are formed so that the prong 260 frictionally slides within the recesses 262 to retain the upper and lower members 252 and 254 together against gravity and hinge resilience forces tending to open the members 202 and 206, but permitting the upper and lower members to be opened to receive a content containing collapsible tube portion as well as to insert or remove the key and collapsible tube. The prongs 260 have the added advantage of maintaining the collapsible tube between the end portions of the jaws. The key of FIG. 30 is similar to the key of FIGS. 24 and 26 but with a hub 264 for spacing the handle 82 from the end wall 230 of the body.

Figure 34:
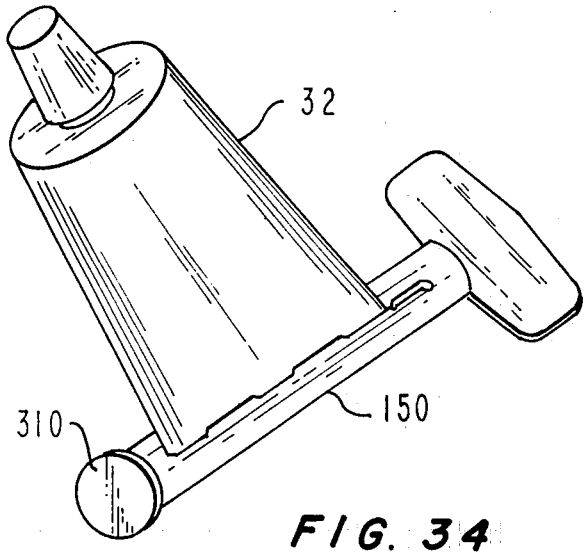
FIG. 34 is a perspective view of the assembled key and pin of FIG. 33.
Figure 33:
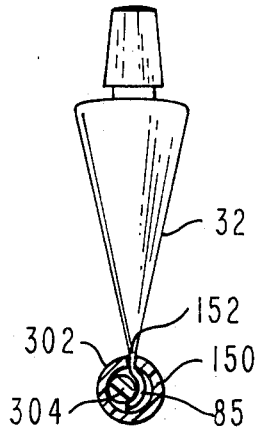
FIG. 33 is a cross-sectional view of the key variation of FIG. 31 and the pin of FIG. 32 assembled with a collapsible tube.

A modified key assembly shown in FIGS. 33 and 34 includes the key 150 with a pin 300. The shank 302 of the key 150 is tubular, and the pin 300 includes a shaft 304 which has a diameter sufficiently smaller than the inside diameter of the inner passage 306 of the key shank 302 to permit the pin shaft 304 to be inserted in the passage 306 while the closed end 85 of the collapsible tube 32 extends in the passage 306 through the slot 152. The diameter of the shaft 304 is sufficient large to produce a bend in the closed end portion 85 of the collapsible tube to retain or clamp the end 85 within the tubular shank 302. For aiding in insertion and removal of the pin 300, the shaft 304 has a pointed end 308 and a head 310 on the opposite end. In use, the closed end 85 of the collapsible tube 32 is inserted into the tubular shank 302, either by longitudinal motion from the open end of shank 302, or by transverse motion through slot 152. Then the shaft 304 of pin 300 is inserted, pointed end 308 first, into the passage 306 to bend and clamp the closed end 85 of the collapsible tube 32. The head 310 is used to conveniently grasp and move the pin 300 during insertion and removal of the pin 300 from the tubular shank.

Since many modifications, variations and changes in detail may be made to the above described embodiments, it is intended that all matter in the foregoing description and shown in the accompanying drawings be interpreted as illustrative and not in a limiting sense.

What is claimed is:

1. A device for squeezing and winding a collapsible tube, the device comprising:

a body including a tubular portion and a pair of jaw portions which are integrally supported on the tubular portion wherein the tubular portion defines a cavity for receiving an empty collapsible tube portion and wherein the jaw portions define an axially extending opening into the cavity and the jaw portions extend outward from the tubular portion on respective opposite sides of the opening, a slotted elongated key for extending axially in the cavity and having a handle portion for winding and pulling an empty portion of the collapsible tube through the opening into the cavity, said tubular portion also having a thickness defining a flexible and resilient wall portion spaced from the opening which permits the jaw portions at the opening to separate and admit a content containing tube portion of the collapsible tube therebetween, said jaw portions having a thickness substantially greater than the flexible wall portion thickness to render the jaw portions more rigid than the flexible wall portion, said jaw portions having inner planar surfaces which extend in parallel planes when the jaw portions are squeezed against the collapsible tube portions to express the contents from the content containing tube portion admitted between the jaw portions, and said jaw portions having outer surfaces for being readily engaged and squeezed by fingers of a user to squeeze the inner surface against the content containing tube portion between the jaws.

2. A device as claimed in claim 1 wherein the inner jaw surfaces extend for a radial length within the range from 5 to 40 mm.

3. A device as claimed in claim 1 wherein the inner surfaces are rib-like.

4. A device as claimed in claim 1 wherein the inner surfaces includes mating serations.

5. A device as claimed in claim 1 wherein the body is formed in two pieces and has interlocking means for joining the pieces together along a joining line opposite the opening.

6. A device as claimed in claim 5 wherein each of the two pieces is formed identically.

7. A device as claimed in claim 1 wherein the key includes a shaft with a longitudinal slot therein for receiving the closed end of the collapsible tube, said slot being sinuous.

8. A device as claimed in claim 1 wherein the key includes rachet means thereon and the body includes pall means thereon for cooperating with the rachet means to prevent rotation of the key in one direction.

9. A device as claimed in claim 1 wherein the body includes a pair of members on which the pair of jaw portions are respectively supported, and the flexible wall portion includes a flexible hinge formed integral with the pair of body portions for permitting the pair of body portions to pivot relative to each other.

10. A device as claimed in claim 9 wherein the pair of body members have semi-annular portions extending over opposite ends thereof to define end wall portions for the cavity and having central openings therein for receiving the key.

11. A device as claimed in claim 10 wherein the key includes annular ridge means defining an annular groove at one end of the key for receiving one of the annular end wall portions to retain the key within the body.

12. A device as claimed in claim 1 wherein the key has a tubular shank with a slot for receiving a closed end of the collapsible tube, and there is included a pin for insertion within the tubular shank to secure the closed end of the collapsible tube therein.

13. A device as claimed in claim 12 wherein the pin includes a shaft with a pointed end and a head on the opposite end.

14. A device for squeezing and winding a collapsible tube, the device comprising:

a body including a tubular portion and a pair of jaw portions which are integrally supported on the tubular portion wherein the tubular portion defines a cavity for receiving an empty collapsible tube portion and wherein the jaw portions define an axially extending opening into the cavity and the jaw portions extend outward from the tubular portion on respective opposite sides of the opening, a slotted elongated key for extending axially in the cavity and having a handle portion for winding and pulling an emplty portion of the collapsible tube through the opening into the cavity, said tubular portion also defining a flexible wall portion spaced from the opening which permits the jaw portions at the opening to separate and admit a content containing tube portion of the collapsible tube therebetween, said jaw portions being substantially more rigid than the flexible wall portion and being adapted for being readily engaged and squeezed by fingers of a user to squeeze the content containing tube portion between the jaws to express the contents from the content containing tube portion admitted therebetween, said jaw portions having respective inner surfaces which extend for a radial length within the range from 5 to 40 mm in corresponding planes extending radially from the axis of the tubular portion, and said jaw portions further having exterior surfaces which are flat and extend tangentially from the exterior surface of the tubular portion so that the exterior surfaces, with the inner jaw surfaces, define a tapered jaw configuration extending from the tubular portion.

15. A device for squeezing and winding a collapsible tube, the device comprising:

a body including a pair of members defining a tubular portion and a pair of jaw portions which are integrally supported on the tubular portion wherein the tubular portion has an axially extending opening and the jaw portions extend outward from the tubular portion on respective opposite sides of the opening, said tubular portion defining a cavity for receiving an empty collapsible tube portion, a slotted elongated key for extending axially in the cavity and having a handle portion for winding and pulling an empty portion of the collapsible tube through the opening into the cavity, said tubular portion also defining a flexible wall portion including a flexible hinge formed integral with the pair of body portions for permitting the pair of body portions to pivot relative to each other and to permit the jaw portions to separate and admit a content containing tube portion of the collapsible tube therebetween, said jaw portions being adapted for being readily engaged and squeezed by fingers of a user to squeeze the content containing tube portion between the jaws to express the contents from the content containing tube portion, and a pair of projecting members extending from opposite sides of one jaw portion for engaging and guiding the other jaw portion.

16. A device as claimed in claim 15 wherein the pair of projecting members have snap means formed thereon for limiting movement of the other jaw portion.

17. A device as claimed in claim 15 wherein the other jaw portion includes recesses frictionally receiving the projecting members.

18. A device for squeezing and winding a collapsible tube, the device comprising:

a body including a tubular portion and a pair of jaw portions which are integrally supported on the tubular portion wherein the tubular portion has an axially extending opening and the jaw portions extend outward from the tubular portion on respective opposite sides of the opening for expressing contents from a content containing portion of the collapsible tube, said tubular portion defining a cavity for receiving an empty portion of the collapsible tube, a slotted elongated key for extending axially in the cavity and having a handle portion for winding and pulling an empty portion of the collapsible tube through the opening into the cavity, said key including a tubular shank with a longitudinal slot therein for receiving the closed end of the collapsible tube, a pin for insertion into and for withdrawal from the tubular shank to secure and to release, respectively, the closed end of the collaspsible tube therein, and said pin including a shaft with a point on one end and a head on the opposite end wherein the shaft has a diameter sufficiently large so that, upon insertion of the shaft into the tubular shank, the closed end of the collapsible tube is clamped between the shaft and the tubular shank, the point on the shaft is designed to bend the closed end of the collapsible tube during insertion of the pin into the tubular shank, and the head is designed to facilitate grasping and withdrawal of the pin from the tubular shank.

* * * * *